US005543884A

United States Patent [19]

Earle et al.

[11] Patent Number: 5,543,884

[45] Date of Patent: Aug. 6, 1996

[54] PHOTOGRAPHIC PROCESSING CHEMICALS

[75] Inventors: Anthony Earle, Harrow Weald; John R. Fyson; Edward C. T. S. Glover, both of London, all of England

[73] Assignee: Eastman Kodak Company, Rochester, N.Y.

[21] Appl. No.: 385,298

[22] Filed: Feb. 10, 1995

[30] Foreign Application Priority Data

Feb. 14, 1994 [GB] United Kingdom ..... 9402763

[51] Int. Cl.[6] ..... G03D 3/02

[52] U.S. Cl. ..... 354/324; 222/81

[58] Field of Search ..... 354/313, 317, 354/322–324, 328, 297; 222/81, 83, 189, 79, 103, 207, 88, DIG. 1; 128/214, 221; 604/252, 406, 126

[56] References Cited

U.S. PATENT DOCUMENTS

| | | | |
|---|---|---|---|
| 3,316,908 | 5/1967 | Burke | 222/189 |
| 3,565,525 | 2/1971 | Sharp | 354/317 X |
| 3,575,099 | 4/1971 | Levenson et al. | 354/328 |
| 3,628,700 | 12/1971 | Dodoghue | 222/207 |
| 3,687,050 | 8/1972 | Wilke | 354/324 |
| 3,831,814 | 8/1974 | Butler | 222/81 |
| 3,868,716 | 2/1975 | Lippert | 354/317 |
| 3,916,061 | 10/1975 | Sullivan | 428/304 |
| 4,289,255 | 9/1981 | Strampe | 222/81 |
| 4,411,661 | 10/1983 | Kersten | 222/81 X |
| 4,437,583 | 3/1984 | O'Connor | 222/108 |
| 4,518,684 | 5/1985 | Martin | 354/328 X |
| 4,846,236 | 7/1989 | Deruntz | 222/81 X |
| 4,871,359 | 10/1989 | Sjonell | 222/81 X |
| 4,941,131 | 7/1990 | Daly et al. | 366/167 |
| 5,048,723 | 9/1991 | Seymour | 222/81 |
| 5,148,208 | 9/1992 | Klosterboer et al. | 354/324 |

FOREIGN PATENT DOCUMENTS

| | | |
|---|---|---|
| 0500371A1 | 2/1992 | European Pat. Off. . |
| 0564970 | 3/1993 | European Pat. Off. . |

OTHER PUBLICATIONS

Patent Abstracts of Japan, vol. 14, No. 160 (P–1028), 28 Mar. 1990, JP–A–02 016545 (Borther Ind Ltd) 19 Jan. 1990.

*Primary Examiner*—D. Rutledge
*Attorney, Agent, or Firm*—Frank Pincelli

[57] ABSTRACT

A cartridge of photographic processing chemical comprises a main body receiving the chemical, the main body having an outlet by way of which the chemical may be introduced into and removed from the main body. The outlet is provided with a closure in the form of a penetrable self-sealing cover incorporating a moisture-absorbing material. A photographic processing apparatus with which the cartridge is used has a supply system for supplying the chemical to a processing tank. The supply system includes a hollow intake needle which is insertable into the cartridge through the self-sealing cover. The cover automatically forms a seal around the needle. As the needle is withdrawn the moisture absorbing material absorbs any photographic processing chemical present on the needle of which may escape from the cartridge and the cover automatically closes up.

11 Claims, 2 Drawing Sheets

PHOTOGRAPHIC PROCESSING CHEMICALS

FIELD OF THE INVENTION

The present invention relates to photographic processing chemicals generally and more particularly to a cartridge containing a photographic processing chemical, to a photographic processing apparatus using such a cartridge and to a method of supplying the chemical to the processing apparatus using the cartridge.

BACKGROUND OF THE INVENTION

A photographic processing apparatus comprises a series of tanks which receive various processing solutions through which photographic material is passed as it is processed. The processing solutions consist of chemicals which can, in some cases, be hazardous to handle. It is therefore known to provide photographic processing solutions as ready-mixed chemicals in reservoirs or containers which can be connected to a photographic processing apparatus by way of tubes incorporating non-drip valves. The processing solution can be pumped into a processing tank and then be returned to the container once it is spent. The operation of connecting the container to the processing tank is, however, awkward and there is a significant risk of the processing chemical coming into contact with the person connecting a new container to the processing apparatus or disconnecting an old one containing a spent processing chemical. Clearly this is a most undesirable situation. While the use of non-drip valves and connectors might assist in reducing this risk, these items comprise many components and are therefore of a relatively complicated construction, are not cheap and may sometimes be unreliable.

The present invention seeks to provide an improved cartridge for photographic processing chemicals and a photographic processing apparatus using the cartridge which addresses the problems outlined above.

SUMMARY OF THE INVENTION

According to one aspect of this invention there is provided a cartridge containing a photographic processing chemical, the cartridge comprising a main body to receive the chemical, the main body having an outlet by way of which the chemical may be introduced into and removed from the main body, the outlet being provided with a closure in the form of a penetrable, self-sealing cover, the closure defining a space within which a moisture-absorbing material is received.

The cover may be formed of a resilient material and be mounted over the outlet of the main body of the cartridge such that the resilience of the material from which the cover is formed creates a seal with that part of the main body which defines the outlet.

Alternatively the self-sealing cover may be formed integrally with the outlet of the main body of the cartridge.

In another arrangement the self-sealing cover may be adapted to be located within an opening forming the outlet of the main body of the cartridge and to form a seal with the outlet upon being inserted into the opening.

In yet a further arrangement the outlet of the main body may be formed with a screw-thread and a threaded cap may be mounted on the outlet with the self-sealing cover being held captive between the outlet and the cap, the cap defining an aperture through which the self-sealing cover is exposed when it is retained upon the outlet by means of the cap.

The moisture-absorbing material may be impregnated with a chemical which renders the chemical contained in the cartridge harmless when the chemical in the cartridge comes into contact with the moisture-absorbing material.

Conveniently the closure comprises two penetrable self-sealing covers, the covers being disposed at opposite ends of the space within which the moisture-absorbing material is received.

Advantageously the or each self-sealing cover is formed from a rubber material.

In a second aspect this there is provided a photographic processing apparatus comprising at least one tank for receiving a photographic processing chemical and a supply system for supplying the chemical to the tank from a supply cartridge as described above, the supply system including a hollow needle connected to the tank, the needle being insertable into the cartridge through the self-sealing cover, the cover forming a seal around the needle when the needle is passed therethrough.

The supply system may include a pair of hollow needles, there being a hollow intake needle by way of which a processing chemical is supplied to the tank from the cartridge and a hollow return needle by way of which the chemical is returned from the tank to the cartridge.

This invention also provides the combination of a photographic processing apparatus as described above with at least one cartridge of photographic processing chemical as described above.

Preferably the photographic processing apparatus includes a plurality of tanks for receiving different photographic processing chemicals and a plurality of supply systems, there being a supply system associated with each processing tank, the needle or needles of each supply system being positioned at predetermined locations relative to each other, there being a cartridge of chemical to be supplied to each processing tank, the cartridges being supported at predetermined positions relative to each other in a common cassette or housing such that the needles of the plurality of supply systems can all be simultaneously inserted into respective cartridges in a single movement.

In another aspect this invention there is provided a method of supplying a photographic processing chemical to a photographic processing apparatus as described above, the method comprising the steps of mounting the above-described cartridge of the photographic processing chemical in position upon the apparatus and piercing the self-sealing cover of the cartridge with the hollow needle of the supply system of the apparatus and transferring the chemical to a tank in the processing apparatus via the needle.

In order that the present invention may be more readily understood and so that further features thereof may be appreciated, the invention will now be described by way of example, with reference to the accompanying drawings.

DETAILED DESCRIPTION OF THE INVENTION

Figure 1:
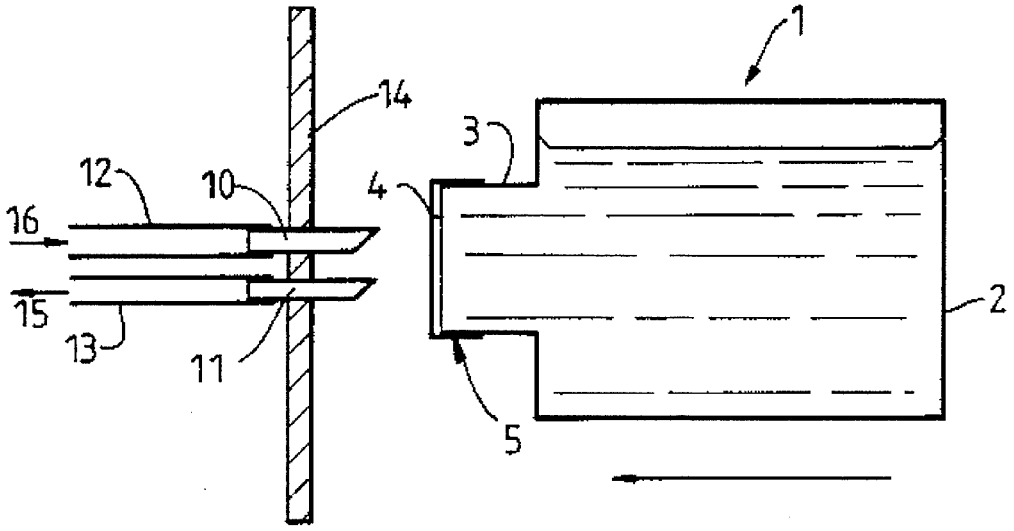
FIG. 1 is a schematic side view of a cartridge of photographic processing chemical in accordance with this invention as it is about to be mounted upon part of a chemical supply system of a photographic processing apparatus.

Referring initially to FIG. 1 of the accompanying drawings, a cartridge for a photographic processing chemical comprises a bottle 1 having a main body 2 for receiving the chemical, the body 2 being formed with a tubular neck 3 which defines an outlet opening 4. The bottle 1 may be a plastic bottle. The neck 3 may be screw-threaded over its outer surface to enable it to receive a cap-like component, to which reference will be made below.

The outlet 4 is closed by means of a penetrable self-sealing cover or septum 5. The septum 5 extends over the opening 4 at the end of the neck 3 so as to form a sealed closure. The septum 5 may be formed of natural or synthetic rubber or any other elastic material with similar properties and which is penetrable yet self-sealing. The septum closure 5 is only illustrated in schematic form in FIG. 1 and is shown in detail in FIG. 2.

While in a basic arrangement the septum 5 may simply be located over enlarged projections formed adjacent the end of the neck 3 in order to provide an elastic, watertight fit, it could be fixed over the bottle outlet in any convenient fashion which provides an effective seal. Thus, for example, the septum may be retained over the outlet opening 4 by means of a screw-threaded cap which fits onto the end of the neck 3 and which is provided with an aperture in its end surface, the cap being screwed onto the neck 3 over the top of the septum 5 so that the septum is trapped beneath the cap and sealed against the neck 3. The septum may, alternatively, be formed integrally as part of the molding of the neck of the bottle 1 or may be part of a separate molding in its own right. With this latter arrangement the separate molding incorporating the septum may be sealingly fitted into a hole forming the outlet of the bottle 1. This arrangement enables the septum to be renewed if the chemical cartridge is to be re-used.

Figure 2:
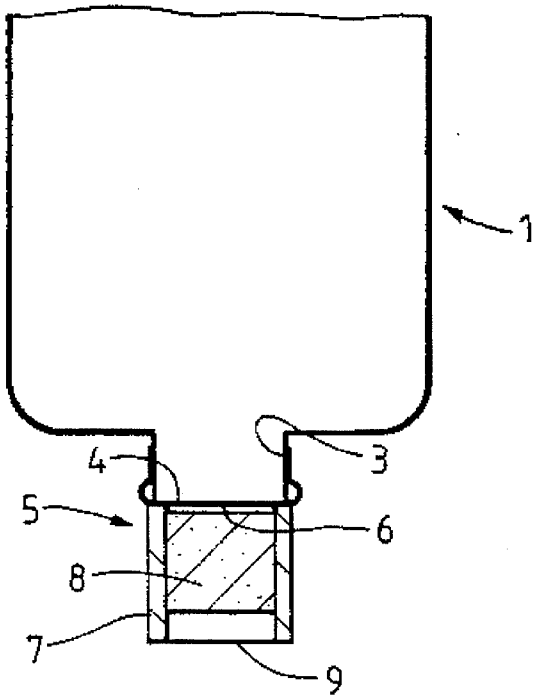
FIG. 2 is a cross-sectional view showing, in greater detail, the outlet region of the cartridge of FIG. 1.

FIG. 2 shows the detailed design of the molded septum closure 5 which, as mentioned above, is designed to be fitted over the end of the neck 3 so as to produce a seal therewith. The molding has a self-sealing cover or septum 6 which is disposed across the outlet of the bottle 1 when in situ. The septum molding also includes an integral tubular extension 7 within which a moisture-absorbing material 8 is received. The moisture-absorbing material may comprise an open celled polyurethane foam, a foam rubber, cotton wool or any other suitably absorbent material. The material may be impregnated with a chemical or chemicals which render harmless the chemical contained within the bottle 1 when that chemical comes into contact with the moisture absorbing material. The free end of the tubular extension 7 of the molding may optionally be formed with an additional septum 9 which acts, among other things, to retain the moisture-absorbing material 8 in place.

It is to be noted that the material from which the septum is formed is constantly in a state of compression. This helps to provide an improved seal, particularly between the neck of the bottle and the septum where the septum is located internally within the neck of the bottle.

In use the bottle 1 receives a ready-mixed photographic processing chemical which is to be supplied to a processing tank in a photographic processing apparatus. When the bottle 1 has been charged with the chemical the septum closure is mounted upon the neck 3 of the bottle in order to seal the outlet 4.

Figure 3:
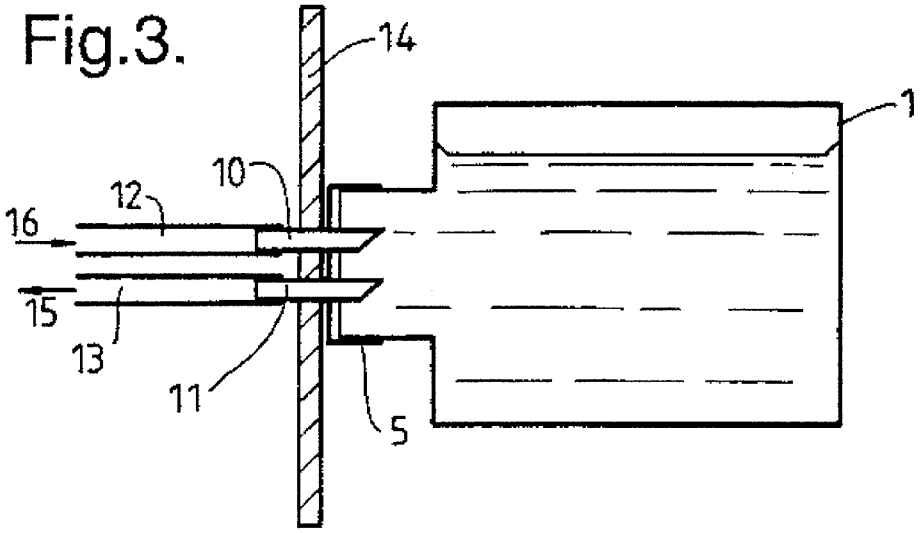
FIG. 3 shows the cartridge of FIG. 1 when it is mounted upon the chemical supply system of the photographic processing apparatus.

A photographic processing apparatus in which the chemicals are to be used is provided with a chemical supply system associated with each processing tank, the supply system incorporating a pair of hollow needles 10,11, such as hypodermic needles, which are connected to the processing tank by way of tubes 12,13 or the like (see FIGS. 1 and 3). The needles 10,11 are held in a support 14 which forms part of the chemical supply system associated with the photographic processing apparatus.

When the chemical contained within the bottle 1 is to be used in the photographic processing apparatus the cartridge is mounted upon the apparatus in the manner shown in FIG. 3 such that the hollow needles 10,11 pass through the outer septum 9, the moisture-absorbing material 8 and the inner septum 6. The processing chemical may then be circulated through the processing bank via the needles 10, 11 and the tubes 12, 13 by means of a pump provided in the processing apparatus. Arrows 15, 16 in FIG. 1 of the drawings illustrate the direction of flow of the chemical as it is pumped into the processing tank and then returned to the cartridge.

When the chemical is spent the circulating pump is switched off and the cartridge is removed from the processing apparatus by simply pulling it off, whereupon the needles 10,11 are withdrawn through the septum 6, the moisture-absorbing material 8 and the septum 9. The moisture-absorbing material 8 serves to wipe off or absorb any drips of chemical which may be present on the ends of the needles as they are withdrawn and thereby ensures that there is no risk of contamination from any chemical which may be left on the ends of the needles. Similarly the material 8 absorbs any chemical which may escape through the septum 6 at the instant when the ends of the needles 10,11 are withdrawn through the septum. Should there still be any chemical residue on the needles 10,11 as they are withdrawn from the moisture-absorbing material 8, the additional end septum 9 will clear any such residues from the needles. As the needles are withdrawn through the septum the holes where the needles previously passed through the septum automatically close up, leaving a watertight seal over the outlet 4 of the bottle. The cartridge can then be safely transported for disposal or recycling.

It will be appreciated that with the cartridge design described above, the cartridge is fully sealed both before and after use. In addition there is virtually no risk of any of the processing chemical escaping from the cartridge as it is being located upon or removed from the processing apparatus because of the way in which the septa automatically form a seal around the external surface of the needles 10,11 when they are passed through the septum and the way in which the septa automatically close up as the needles are withdrawn. The fact that the material from which the septum is formed is in a state of compression helps to produce an effective seal around the needles when they have penetrated the septum and also to produce an effective seal when the needles have been removed.

While an arrangement has been described in which the chemical supply system associated with the photographic processing apparatus comprises a pair of needles 10,11 this arrangement is only intended to enable the chemical to be circulated through a processing tank and where the cartridge 1 is to be used merely to replenish a static supply of chemical processing solution in a processing tank, the chemical supply system need only have one hollow needle which is passed through the septum and into the bottle 1 when the bottle is mounted upon the apparatus, a pump then drawing the chemical from the bottle to the processing tank.

It is not essential that the needles 10,11 be sharp as shown in the accompanying drawings. In a slightly modified arrangement the septum could be pre-pierced as it is produced in the factory with the pierced site automatically closing as a result of the inherent properties of the material from which it is formed and from the fact that this material is in a state of compression when it is located upon the bottle or cartridge 1. The pre-pierced site on the septum can be marked in any appropriate manner. The chemical supply system associated with the photographic processing apparatus may then use one or more needles which are round-nosed, hollow needles which are closed at their free end but which have a hole extending into their hollow interior from one side at a position displaced from the free end of the needle. The round-nosed needles can then be used to penetrate the marked, pre-pierced site on the septum so that the hole in the side of the needle is located within the bottle or cartridge 1 thereby enabling the photographic processing chemical to be withdrawn from the bottle or cartridge.

While the cartridge has been illustrated as lying horizontally in FIGS. 1 and 3, it could of course be disposed vertically with the outlet 4 directed downwardly, as shown in FIG. 2, or at any other orientation which permits the chemical to be withdrawn from and returned to the cartridge.

The photographic processing apparatus will, of course, have a number of processing tanks, each of which receives a different processing chemical. Each processing tank will be associated with its own chemical supply system for receiving a processing chemical from a cartridge as shown in FIGS. 1 to 3 of the drawings.

Figure 4:
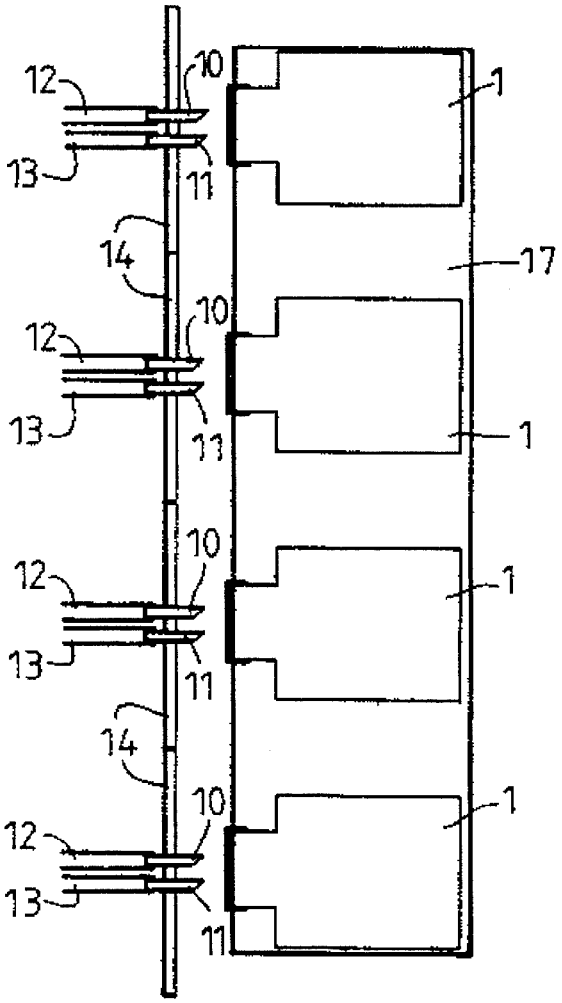
FIG. 4 is a schematic illustration of a bank of cartridges of the type shown in FIGS. 1 to 3 for use in supplying a plurality of chemicals to the supply systems of a photographic processing unit.

FIG. 4 illustrates one way in which a plurality of cartridges 1 may be interconnected or provided in a common holder or cassette 17 such that they are held at predetermined positions relative to each other. The chemical supply systems associated with the various processing tanks are similarly positioned relative to each other such that the single cassette or housing 17 can be mounted upon the processing apparatus in one operation which results in all of the appropriate cartridges 1 being connected to their respective chemical supply systems with the needles 10,11 passing through the septa on the outlets of the cartridges. When a processing apparatus is being set up for use, it is a very simple operation to locate the appropriate cartridges of processing chemicals in the cassette 17 and then to mount the cassette on the processing apparatus in a single movement. It would, of course, be a far more time-consuming operation to have to connect each of the different cartridges to the apparatus individually.

It will be appreciated that using a self-sealing cover for the chemical cartridges which can be penetrated by the needles of the chemical supply system for the photographic processing apparatus is a very simple and therefore inexpensive method of sealing the cartridges. It permits the cartridges to be mounted upon the processing apparatus and removed therefrom without the need to in any way open or undo a closure on the cartridge and therefore requires the minimum of handling by an operator. The arrangement of a moisture-absorbing material within the cover reduces any risk of contamination from chemicals escaping from the cartridge as it is located on the processing apparatus or from chemicals present on the apparatus itself when the cartridge is removed. The cartridges, including the septum closure, may be recycled after they have been removed containing a spent processing chemical.

It is to be understood that various changes and modifications may be made without departing from the scope of the present invention, the present invention being limited by the following claims. Parts List

1 . . . bottle or cartridge
2 . . . main body
3 . . . tubular neck
4 . . . outlet opening
5 . . . septum
6 . . . inner septum
7 . . . integral tubular extension
8 . . . moisture-absorbing material
9 . . . outer septum
10,11 . . . hollow needles
12,13 . . . tubes
14 . . . support
15,16 . . . arrows
17 . . . common holder, housing or cassette

We claim:

1. A cartridge containing a photographic processing chemical, the cartridge comprising a main body to receive the chemical, the main body having an outlet by way of which the chemical may be introduced into and removed from the main body, the outlet being provided with a closure which defines a space within which a moisture-absorbing material is received, the closure comprising a first and a second penetrable, self-sealing cover, the first and second covers being disposed at opposite ends of the space within which the moisture-absorbing material is received.

2. A cartridge according to claim 1, wherein at least the first cover is formed of a resilient material and the first cover is mounted over the outlet of the main body of the cartridge such that the resilience of the material from which the first cover is formed creates a seal with that part of the main body which defines the outlet.

3. A cartridge according to claim 2, wherein the first self-sealing cover is integrally formed with the outlet of the main body of the cartridge.

4. A cartridge according to claim 1, wherein the closure is adapted to be located within an opening forming the outlet of the main body of the cartridge and to form a seal with the outlet upon being inserted into the opening.

5. A cartridge according to claim 1, wherein the outlet of the main body is formed with a screw-thread and a threaded cap is mounted on the outlet with the first self-sealing cover of the closure being held captive between the outlet and the cap, the cap defining an aperture through which the first self-sealing cover is exposed when it is retained upon the outlet by means of the cap.

6. A cartridge according to claim 1, wherein the moisture-absorbing material is impregnated with a chemical which renders the chemical contained in the cartridge harmless when the chemical in the cartridge comes into contact with the moisture-absorbing material.

7. A cartridge according to claim 1, wherein each self-sealing cover is formed from a rubber material.

8. A photographic processing apparatus comprising at least one tank for receiving a photographic processing chemical and a supply system for supplying the chemical to the tank from a supply cartridge containing a photographic processing chemical, the cartridge comprising a main body to receive the chemical, the main body having an outlet by way of which the chemical may be introduced into and removed from the main body, the outlet being provided with a closure which defines a space within which a moisture-absorbing material is received, the closure comprising a first and a second penetrable, self-sealing cover, the first and second covers being disposed at opposite ends of the space within which the moisture-absorbing material is received, the supply system including a hollow needle connected to the tank, the needle being insertable into the cartridge through the self-sealing cover, the cover forming a seal around the needle when the needle is passed therethrough.

9. A photographic processing apparatus according to claim 8, wherein the supply system includes a pair of hollow needles, there being a hollow intake needle byway of which a processing chemical is supplied to the tank from the cartridge and a hollow return needle by way of which the chemical is returned from the tank to the cartridge.

10. A photographic processing apparatus according to claim 9 wherein the apparatus includes a plurality of tanks for receiving different photographic processing chemicals and a plurality of supply systems, there being a supply system associated with each processing tank, the needle or needles of each supply system being positioned at predetermined locations relative to each other, there being a cartridge of chemical to be supplied to each processing tank, the cartridges being supported at predetermined positions relative to each other in a common cassette or housing such that the needles of the plurality of supply systems can all be simultaneously inserted into respective cartridges in a single movement.

11. A method of supplying a photographic processing chemical to a photographic processing apparatus comprising at least one tank for receiving a photographic processing chemical and a supply system for supplying the chemical to the tank from a supply cartridge containing a photographic processing chemical, the cartridge comprising a main body to receive the chemical, the main body having an outlet by way of which the chemical may be introduced into and removed from the main body, the outlet being provided with a closure which defines a space within which a moisture-absorbing material is received, the closure comprising a first and a second penetrable, self-sealing cover, the first and second covers being disposed at opposite ends of the space within which the moisture-absorbing material is received, the supply system including a hollow needle connected to the tank, the needle being insertable into the cartridge through the self-sealing cover, the cover forming a seal around the needle when the needle is passed therethrough, the method comprising the steps of:

mounting said cartridge in position upon the apparatus and piercing the self-sealing covers of the cartridge with the hollow needle of the supply system of the apparatus and transferring the chemical to a tank in the processing apparatus via the needle.

* * * * *